US008185018B2

(12) United States Patent
Funamoto et al.

(10) Patent No.: US 8,185,018 B2
(45) Date of Patent: May 22, 2012

(54) METHOD AND APPARATUS FOR IMAGE FORMING CAPABLE OF EFFECTIVELY ELIMINATING COLOR DISPLACEMENT BY RECOGNIZING A ROTATIONAL POSITION OF A ROTATING MEMBER WITH A MECHANISM USING DETECTION MARKS

(75) Inventors: Noriaki Funamoto, Yokohama (JP); Joh Ebara, Kamakura (JP); Toshiyuki Uchida, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 2 days.

(21) Appl. No.: 12/826,274

(22) Filed: Jun. 29, 2010

(65) Prior Publication Data

US 2010/0266299 A1 Oct. 21, 2010

Related U.S. Application Data

(62) Division of application No. 11/689,956, filed on Mar. 22, 2007, now Pat. No. 7,773,914, which is a division of application No. 10/911,603, filed on Aug. 5, 2004, now Pat. No. 7,206,537.

(30) Foreign Application Priority Data

Aug. 5, 2003 (JP) ..... 2003-286738

(51) Int. Cl.
*G03G 15/00* (2006.01)

(52) U.S. Cl. ..... 399/167

(58) Field of Classification Search ..... 399/167, 399/301, 356

See application file for complete search history.

(56) References Cited

U.S. PATENT DOCUMENTS

| | | | | |
|---|---|---|---|---|
| 5,412,302 | A * | 5/1995 | Kido et al. | 318/685 |
| 5,608,394 | A | 3/1997 | Hirabayashi | |
| 5,758,233 | A * | 5/1998 | Coffey et al. | 399/111 |
| 5,799,229 | A | 8/1998 | Yokoyama et al. | |
| 5,878,317 | A | 3/1999 | Masuda et al. | |
| 5,946,529 | A | 8/1999 | Sato et al. | |
| 6,248,993 | B1 * | 6/2001 | Bunselmeier et al. | 250/231.13 |
| 6,447,189 | B1 | 9/2002 | Omura | |
| 6,725,991 | B2 | 4/2004 | Murano et al. | |
| 6,779,975 | B2 | 8/2004 | Takashima et al. | |
| 2002/0089579 | A1 | 7/2002 | Yamanaka et al. | |

(Continued)

FOREIGN PATENT DOCUMENTS

JP 58-018670 2/1983

(Continued)

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes a rotating member, a motor configured to rotate the rotating member, and a marking member having primary and secondary portions. The image forming apparatus also includes a mark sensor configured to detect the primary and secondary portions, and output a primary signal and a secondary signal, and a position sensor configured to determine a rotational position of the rotating member based on a primary reception time of one of the primary and secondary signals that comes immediately after the other of the primary and secondary signals when the position sensor receives the other of the primary and secondary signals at a start of a mark detecting operation. Further, the image forming apparatus includes a motor controller configured to control the motor based on the recognition result and make the rotational position consistent with a target position at a predetermined time during the mark detecting operation.

19 Claims, 8 Drawing Sheets

U.S. PATENT DOCUMENTS

| | | | |
|---|---|---|---|
| 2003/0021613 | A1 | 1/2003 | Koide |
| 2003/0180072 | A1 | 9/2003 | Ohashi et al. |
| 2003/0231364 | A1 | 12/2003 | Shoji et al. |
| 2006/0024104 | A1 | 2/2006 | Castelli et al. |

FOREIGN PATENT DOCUMENTS

| | | | | |
|---|---|---|---|---|
| JP | 58-58402 | | | 4/1983 |
| JP | 60-100015 | | | 6/1985 |
| JP | 63204803 | A | * | 8/1988 |
| JP | 01-227167 | | | 9/1989 |
| JP | 01-240821 | | | 9/1989 |
| JP | 3-42611 | | | 6/1991 |
| JP | 3-072314 | | | 7/1991 |
| JP | 3-207678 | | | 9/1991 |
| JP | 5-88501 | | | 4/1993 |
| JP | 9-146329 | | | 6/1997 |
| JP | 9-230657 | | | 9/1997 |
| JP | 10110800 | A | * | 4/1998 |
| JP | 11262959 | A | * | 9/1999 |
| JP | 2001-92194 | | | 4/2001 |
| JP | 2001-092194 | A | | 4/2001 |
| JP | 2001-134039 | | | 5/2001 |
| JP | 2001-305820 | | | 11/2001 |
| JP | 2002-311672 | | | 10/2002 |
| JP | 2003-162119 | A | | 6/2003 |
| JP | 2003241573 | A | * | 8/2003 |
| JP | 4042127 | | | 11/2007 |
| WO | WO 00/40419 | | | 7/2000 |

* cited by examiner

METHOD AND APPARATUS FOR IMAGE FORMING CAPABLE OF EFFECTIVELY ELIMINATING COLOR DISPLACEMENT BY RECOGNIZING A ROTATIONAL POSITION OF A ROTATING MEMBER WITH A MECHANISM USING DETECTION MARKS

CROSS REFERENCE TO RELATED APPLICATIONS

The present application is a divisional application of U.S. patent application Ser. No. 11/689,956, filed Mar. 22, 2007, now U.S. Pat. No. 7,773,914 which is a divisional application of U.S. patent application Ser. No. 10/911,603, filed Aug. 5, 2004, now U.S. Pat. No. 7,206,537, issued Apr. 17, 2007, which claims priority under 35 U.S.C. §119 to Japanese Patent Application No. 2003-286738 filed on Aug. 5, 2003 in the Japanese Patent Office, the entire contents of each of which are incorporated herein by reference.

BACKGROUND OF THE INVENTION

1. Field of the Invention

The present invention relates to a method and apparatus for image forming, particularly to a method and apparatus for image forming capable of effectively eliminating color displacement by recognizing a rotational position of a rotating member to meet with its target position at a predetermined time, a rotation drive unit included in the apparatus for rotating the rotating member, and a detachable process cartridge detachably provided to the apparatus and including the rotating member.

2. Discussion of the Background

Recently, market demands for image forming apparatuses producing color images have been increasing.

The image forming apparatuses include different types of color image forming apparatuses having different structures. One of the color image forming apparatuses includes one drum-shaped image bearing member, and is referred to as a one-drum image forming apparatus. The one-drum image forming apparatus repeats four cycles of image forming operations to produce a full-color image. In one cycle of the image forming operations, the drum-shaped image bearing member bears an electrostatic latent image of a single color on a surface thereof. The electrostatic latent image formed according to image data corresponding to the single color is developed as a toner image, and is transferred onto an image receiving member, such as an intermediate transfer member and a recording medium. After four cycles of operations similar to those as described above are performed, a full-color image can be obtained.

Since the one-drum image forming apparatus includes one image bearing member, the apparatus can achieve reduction in size and costs. On the other hand, the one-drum image forming apparatus needs to perform a series of image forming operations, such as a charging operation, an optical writing operation, a developing operation, a transferring operation and so forth, for four cycles to produce a full color image. With this structure, it is difficult to speed up the image forming operations.

The image forming apparatuses include another color image forming apparatus that has a plurality of image bearing members for respective toners of different colors. This color image forming apparatus is referred to as a tandem image forming apparatus. While the tandem image forming apparatus performs similar image forming operations to those performed by the one-drum image forming apparatus, the structures of both image forming apparatuses are different. The plurality of image bearing members of the tandem image forming apparatus bear respective electrostatic latent images on respective surfaces thereof. The respective electrostatic latent images formed on the surfaces of the plurality of respective image bearing members are developed as respective toner images of different colors, and are sequentially transferred onto an image receiving member to produce a full color image in one cycle. That is, the above-described series of image forming operations are performed in one cycle.

Although it is difficult to reduce the size and cost of the tandem image forming apparatus, a full color image can be produced in one cycle of image forming operations, which speeds up the image forming operations.

Further, according to the demands from the market that a color image forming apparatus has a speed level equivalent to that of a monochrome image forming apparatus, the tandem image forming apparatus draws attentions of the market.

However, since the above-described tandem image forming apparatus sequentially overlays color toner images formed on the plurality of image bearing members onto the image receiving member, the overlaid image may have color displacements. The color displacements occur due to several causes such as an eccentricity of a drive gear provided to the image bearing member, a lack of accuracy of gear molding, variations of a rotation speed caused by a joint that engages the drive gear with the image bearing member, and so forth. The eccentricity of the drive gear of the image bearing member periodically causes variations of a surface travel velocity of the image bearing member, resulting in elongation and shrink of lengths in the respective toner images when the toner images are transferred onto the image receiving member. When the periodic elongation and shrink caused by variations of the surface travel velocity of the image bearing member do not agree with those of the other image bearing members, a color displacement occurs. The color displacement may occur in an area that is formed between each of the respective image bearing members and the image receiving member. The area is referred to as a transfer area where the toner images formed on the respective image bearing members are transferred. If the surface travel velocity of the image receiving member in the transfer area changes because of variations of the surface travel velocities of the image bearing members, the eccentricity of a rotating shaft of the image bearing member may also cause the color displacement. When an image bearing member has an eccentricity in its rotating shaft, the image bearing member may have a slowest surface travel velocity at a portion of the surface that is closest to the eccentric rotating shaft, and may have a fastest surface travel velocity at a portion of the surface that is farthest from the eccentric rotating shaft.

Some techniques have been proposed to prevent the color displacements by periodically changing the surface travel velocity of the image bearing member. The tandem color image forming apparatus having the above-described techniques forms a pattern image on the surface of the image receiving member from the plurality of image bearing members. By reading the pattern image, the tandem color image forming apparatus detects periodic variations in the surface travel velocities of the plurality of respective image bearing members. Based on the detection results, the periodic variations in the surface travel velocities of the plurality of the respective image bearing members are adjusted so that the surface travel velocities of the plurality of respective image bearing members can agree with each other on the surface of the image receiving member, and the color displacements can be prevented.

To perform the above-described adjustment, rotational positions of respective image bearing members need to be previously determined. One of the above-described techniques uses a detection mark to detect the rotational positions. The detection mark is a target that moves on a rotation path of the image bearing member and is optically or magnetically detected by a mark detection unit. With the above-described technique, the mark detection unit detects the detection mark every time the detection mark passes the mark detection unit in rotations of the image bearing member, and the rotational position of the image bearing member can be uniquely determined. Therefore, the rotational position of each image bearing member can be determined by detecting the detection mark.

However, when the rotational position of the image bearing member is determined using the technique, a problem occurs as described below.

To determine the rotational position of the image bearing member, the image bearing member is first rotated. After the surface travel velocity of the image bearing member becomes stable, a detecting operation of the detection mark starts. The detection mark is generally detected at a time when a leading end of the detection mark reaches to a detection area of the mark detection unit or at a time when a trailing end of the detection mark passes out the detection area of the mark detection unit. When the mark detection unit is set to detect the detection mark when the leading end of the detection mark goes out of the detection area, if the detecting operation starts immediately after the leading edge of the target goes out of the detection area, the mark detection unit has to wait for another cycle until the leading end of the detection mark comes to the detection area again. That is, the rotational position of the image bearing member cannot be detected until the image bearing member rotates one more cycle, which may delay a start of the above-described adjustments.

As a result of the above-described problem, a start of the image forming operation performed after the above-described adjustments may delay for one rotation of the image bearing member at the maximum, and a first print time after the above-described adjustments may also delay. The above-described series of delay may also occur when the mark detection unit is set to detect the detection mark immediately after the trailing end of the detection mark passed out of the detection area. Since the market strongly demands to reduce the first print time, the reduction of the speed of the first print time is significantly important in the technical field of an image forming apparatus.

As described above, a delay of detecting the detection mark may occur when the rotational position of the image bearing member provided in the image forming apparatus is detected to match the target position at a predetermined time. That is, the above-described problem may also occur when a rotational position of a rotating member is detected to adjust the rotational position of the rotating member to agree with the target position at a predetermined time.

SUMMARY OF THE INVENTION

The present invention has been made in view of the above-described circumstances.

An object of the present invention is to provide a novel image forming apparatus capable of immediately recognizing a rotational position of a rotating member and rapidly adjusting the rotational position to agree with a target position.

Another object of the present invention is to provide a novel rotating drive unit included in the image forming apparatus to rotate a rotating member and adjust the rotational position to agree with the target position at the predetermined time.

Another object of the present invention is to provide a novel process cartridge including a rotating drive unit so that the rotational position of the rotating member can be adjusted to agree with the target position.

A novel image forming apparatus includes a frame, a rotating member, a motor, a marking member, a mark sensor, a position sensor and a motor controller. The rotating member has open end portions in a rotation axial direction thereof. The motor rotates the rotating member. The marking member is configured to mark a rotational position of the rotating member. The marking member has a primary portion and a secondary portion along a circumference thereof, is fixedly disposed at one of the open end portions of the rotating member, and concentrically rotates with the rotating member on a rotation path of the circumference thereof. The mark sensor is configured to perform a mark detecting operation for detecting the primary portion and the secondary portion of the marking member, and outputting a primary signal when detecting the primary portion and a secondary signal when detecting the secondary portion. The position sensor is configured to determine the rotational position of the rotating member based on a primary reception time to start receiving one of the primary and secondary signals generated at a start of the mark detecting operation performed by the mark sensor. The motor controller is configured to control the motor based on a determination result obtained by the position sensor to make the rotational position of the rotating member in agreement with a target position at a predetermined time.

The position sensor may determine the rotational position of the rotating member based on a primary reception time of the primary signal coming immediately after the secondary signal when the position sensor receives the secondary signal at the start of the mark detecting operation.

The position sensor may determine the rotational position of the rotating member based on a primary reception time of the secondary signal coming immediately after the primary signal when the position sensor receives the primary signal at the start of the mark detecting operation.

The primary portion of the marking member may include a detection mark and the secondary portion of the marking member includes a mark-to-mark interval.

The detection mark may be half a length of a circumference thereof.

The primary portion of the marking member may include a plurality of detection marks and the secondary portion of the marking member includes a plurality of mark-to-mark intervals and the mark sensor may output the primary signal each time when detecting the plurality of detection marks and the secondary signal each time when detecting the plurality of mark-to-mark intervals.

At least two of the plurality of detection marks may have different lengths from each other in a rotating direction of the marking member, and the position sensor may determine the rotational position of the rotating member based on a primary reception time of the primary signal corresponding to one of the at least two of the plurality of detection marks and a secondary reception time of the secondary signal corresponding to the mark-to-mark interval coming immediately after the one of the at least two of the plurality of detection marks after the start of the mark detecting operation.

At least two of the plurality of mark-to-mark intervals may have different lengths in a rotating direction of the marking member, and the position sensor may determine the rotational position of the rotating member based on a primary reception time of the secondary signal corresponding to one of the at least two of the plurality of mark-to-mark intervals and a secondary reception time of the primary signal corresponding to the detection mark coming immediately after the one of the at least two of the plurality of mark-to-mark intervals after the start of the mark detecting operation.

At least three of the plurality of detection marks and the at least three of the plurality of mark-to-mark intervals may have different lengths in a rotating direction of the marking member, and the position sensor may determine the rotational position of the rotating member based on a primary reception time of one of the primary signal corresponding to one of the at least three of the plurality of detection marks and the secondary signal corresponding to one of the at least three of the plurality of mark-to-mark intervals, and a secondary reception time of one of the primary signal and the secondary signal coming immediately after the primary reception time after the start of the mark detecting operation.

The marking member may include a plurality of combinations including one of the plurality of detection marks and one of the plurality of mark-to-mark intervals adjacent to the one of the plurality of detection marks at one of upstream and downstream of a moving direction of the detection mark, and the plurality of combinations may have an equal length in the moving direction of the detection mark.

The rotating member may include a plurality of rotating members, the motor includes a plurality of motors, and the position sensor includes a plurality of position sensors corresponding to the plurality of respective motors. The novel image forming apparatus further includes a control mechanism configured to control the position sensor and the motor controller, and make relative relationships of the plurality of rotating members have predetermined relations after the rotational positions of the plurality of respective rotating members are determined.

In one exemplary embodiment, a novel method for image forming includes the steps of rotating a rotating member by generating a drive force by a motor, moving a marking member having a primary portion and a secondary portion along a circumference thereof by concentrically rotating with the rotating member on a rotation path of the circumference thereof to mark a rotational position of the rotating member, detecting the primary portion and the secondary portion of the marking member with a mark sensor, outputting a primary signal when the primary portion is detected and a secondary signal when the secondary portion is detected, determining the rotational position of the rotating member with a position sensor, based on a primary reception time of one of the primary and secondary signals, the one of the primary and secondary signals coming immediately after the other of the primary and secondary signals when the position sensor receives the other of the primary and secondary signals at a start of the detecting step, and controlling the motor with a motor controller, based on the recognition result obtained by the position sensor and make the rotational position of the rotating member consistent with a target position at a predetermined time during the detecting step.

The determining step may determine the rotational position of the rotating member based on a primary reception time of the primary signal coming immediately after the secondary signal when the position sensor receives the secondary signal at the start of the detecting step.

The determining step may determine the rotational position of the rotating member based on a primary reception time of the secondary signal coming immediately after the primary signal when the position sensor receives the primary signal at the start of the detecting step.

The determining step may determine the rotational position of the rotating member based on a primary reception time of the primary signal corresponding to one of the at least two of the plurality of detection marks and a secondary reception time of the secondary signal corresponding to the mark-to-mark interval coming immediately after the one of the at least two of the plurality of detection marks after the start of the detecting step.

At least two of the plurality of mark-to-mark intervals may have different lengths in a rotating direction of the marking member, and the determining step may determine the rotational position of the rotating member based on a primary reception time of the secondary signal corresponding to one of the at least two of the plurality of mark-to-mark intervals and a secondary reception time of the primary signal corresponding to the detection mark coming immediately after the one of the at least two of the plurality of mark-to-mark intervals after the start of the detecting step.

At least three of the plurality of detection marks and the at least three of the plurality of mark-to-mark intervals may have different lengths in a rotating direction of the marking member, and the determining step may determine the rotational position of the rotating member based on a primary reception time of one of the primary signal corresponding to one of the at least three of the plurality of detection marks and the secondary signal corresponding to one of the at least three of the plurality of mark-to-mark intervals, and a secondary reception time of one of the primary signal and the secondary signal coming immediately after the primary reception time after the start of the detecting step.

The rotating member may include a plurality of rotating members, the motor includes a plurality of motors, and the position sensor includes a plurality of position sensors corresponding to the plurality of respective motors. The novel image forming method may further include the step of managing the determining step and the controlling step, and make relative relationships of the plurality of rotating members have predetermined relations after the rotational positions of the plurality of respective rotating members are determined.

In one exemplary embodiment, a novel image forming apparatus includes a plurality of image bearing members, a plurality of motors, an image receiving member, a plurality of position sensors, a plurality of motor controllers, a storing mechanism and a control mechanism. The plurality of image bearing members may have open end portions in an axial direction thereof and bear toner images on surfaces thereof. The plurality of motors may rotate the plurality of image bearing members. The image receiving member may receive and overlay the toner images from the plurality of image bearing members facing a surface of the image receiving member, and move the overlaid toner images in a moving direction thereof. The plurality of position sensors may determine a rotational position of the plurality of image bearing members based on a primary reception time of a signal that comes immediately after a preceding signal when the plurality of position sensors receive the preceding signal at a start of a mark detecting operation. The plurality of motor controllers may control the motor based on the recognition result obtained by the position sensor and make the rotational position of the rotating member consistent with a target position at a predetermined time during the mark detecting operation performed by the mark sensor. The storing mechanism may store relative relationship data specifying a relative relationship of the rotational positions between the plurality of image bearing members to have a minimal degree of color displacements between the toner images overlaid on the surface of the image receiving member. The control mechanism may control at least one of the plurality of motor controllers, and make relative relationships of the plurality of image bearing members have relative relationships based on the relative relationship data specifying the relative relationship stored in the storing mechanism after the rotational positions of the plurality of respective image bearing members are determined.

The novel image forming apparatus may further include a data registering mechanism configured to register data specifying a relative relationship of the rotational positions between the plurality of image bearing members as the relative relationship data, the data causing toner images formed on surfaces of the plurality of image bearing members having one of maximum and minimum surface velocities to be transferred onto an identical portion on a surface of the image receiving member.

The data registering mechanism may process the relative relationship data every time a number of accumulated images reach a predetermined number.

The data registering mechanism may process the relative relationship data during a period after a replacement of at least one of the plurality of image bearing members and before a next image forming operation starts.

In one exemplary embodiment, a novel method for image forming includes the steps of rotating a plurality of image bearing members by generating drive force by a plurality of motors, forming toner images on surfaces of the plurality of image bearing members, overlaying the toner images from the plurality of image bearing members onto an image receiving member facing the surfaces of the plurality of image bearing members, determining respective rotational positions of the plurality of image bearing members using a plurality of position sensors based on a primary reception time of a signal that comes immediately after a preceding signal when the plurality of position sensors receive the preceding signal at a start of a mark detecting operation, controlling the plurality of motors using a plurality of respective motor controllers based on the determination result obtained by the plurality of position sensors to make the rotational position of the rotating member consistent with a target position at a predetermined time during the mark detecting operation, storing relative relationship data to a storing mechanism, the data specifying respective relative relationship of the rotational positions between the plurality of image bearing members to have a minimal degree of color displacements between the toner images overlaid on the surface of the image receiving member, and managing at least one of the plurality of motor controllers to make relative relationships of the plurality of image bearing members have relative relationships based on the relative relationship data specifying the relative relationship stored in the storing step after the rotational positions of the plurality of image bearing members are determined.

The novel method may further include the step of registering data to a data registering mechanism, the data specifying relative relationships of the rotational positions between the plurality of image bearing members as the relative relationship data, the data causing toner images formed on surfaces of the plurality of image bearing members having one of maximum and minimum surface velocities to be transferred onto an identical portion on a surface of the image receiving member.

The registering step may process the relative relationship data every time a number of accumulated images reach a predetermined number.

The registering step may process the relative relationship data during a period after a replacement of at least one of the bearing means and before a next image forming operation starts.

In one exemplary embodiment, a novel rotation drive mechanism includes a rotating member, a motor, a marking member, a mark sensor, a position sensor and a mark controller. The rotating member may have open end portions in an axial direction thereof. The motor may be configured to rotate the rotating member. The marking member may have a primary portion and a secondary portion along a circumference thereof, may be fixedly disposed at a center of one of the open end portions, and may be configured to rotate concentrically with the rotating member on a rotation path of the circumference thereof. The mark sensor may be configured to detect the primary portion and the secondary portion of the marking member, and output a primary signal when the primary portion is detected and a secondary signal when the secondary portion is detected. The position sensor may be configured to determine a rotational position of the rotating member based on a primary reception time of one of the primary and secondary signals, the one of the primary and secondary signals coming immediately after the other of the primary and secondary signals when the position sensor receives the other of the primary and secondary signals at a start of a mark detecting operation. The motor controller may be configured to control the motor based on the recognition result obtained by the position sensor and make the rotational position of the rotating member consistent with a target position at a predetermined time during the mark detecting operation performed by the mark sensor.

In one exemplary embodiment, a novel process cartridge in use for an image forming apparatus includes an image bearing member, a motor, at least one image forming component, a marking member, a mark sensor, a position sensor and a motor controller. The image bearing member may be configured to bear a toner image on a surface thereof. The motor may be configured to rotate the image bearing member. The at least one image forming component may be integrally mounted in a vicinity of the image bearing member. The marking member may be configured to mark a rotational position of the image bearing member. The marking member may have a primary portion and a secondary portion along a circumference thereof, and may concentrically rotate with the image bearing member on a rotation path of the circumference thereof. The mark sensor may be configured to detect the primary portion and the secondary portion of the marking member, and output a primary signal when the primary portion is detected and a secondary signal when the secondary portion is detected. The position sensor may be configured to determine the rotational position of the image bearing member based on a primary reception time of one of the primary and secondary signals, the one of the primary and secondary signals coming immediately after the other of the primary and secondary signals when the position sensor receives the other of the primary and secondary signals at a start of a mark detecting operation. The motor controller may be configured to control the motor based on the recognition result obtained by the position sensor and make the rotational position of the image bearing member consistent with a target position at a predetermined time during the mark detecting operation performed by the mark sensor. The at least one image forming component may include a charging unit, a developing unit and a cleaning unit. The novel process cartridge may be detachable from the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
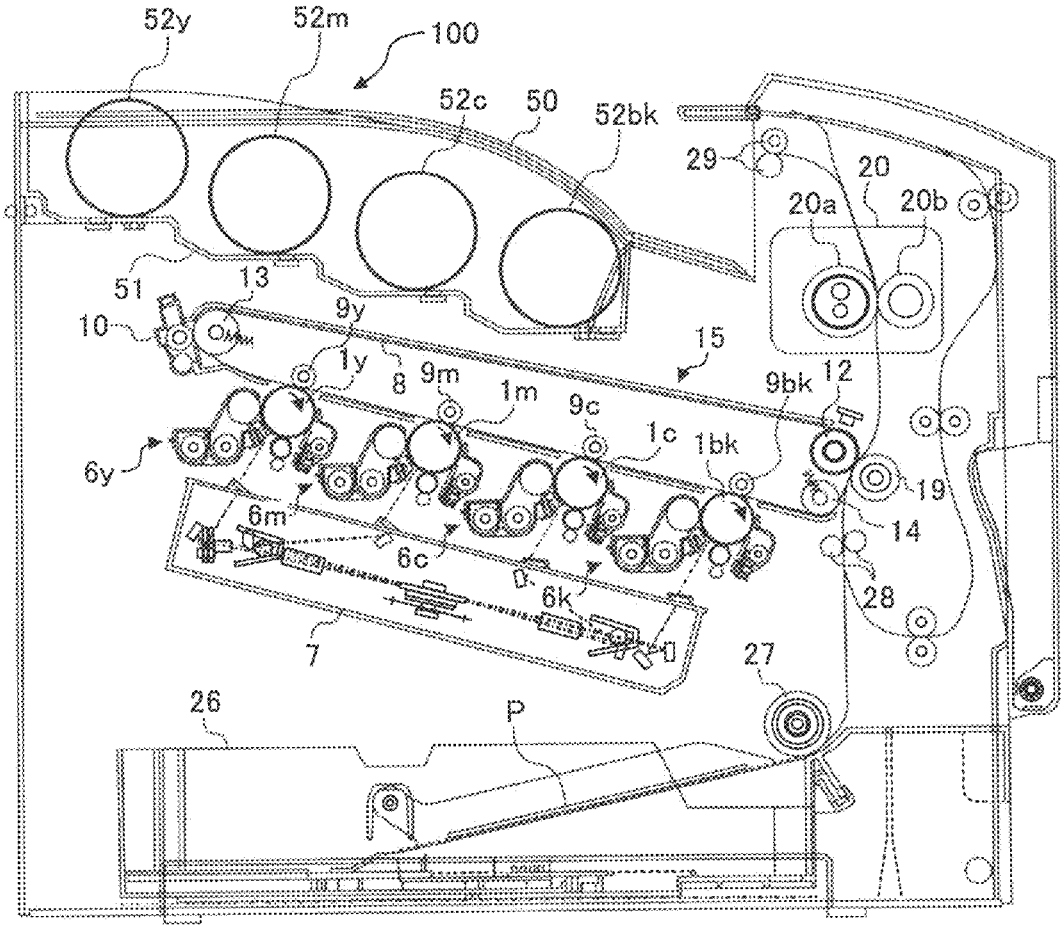
FIG. 1 is a schematic structure of a printer according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, an electrophotographic printer is described as an exemplary embodiment of the present invention. Hereinafter, the electrophotographic printer is referred to as a printer 100.

The printer 100 shown in FIG. 1 includes four process cartridges 6*y*, 6*c*, 6*m* and 6*bk* as an image forming mechanism, four toner bottles 52*y*, 52*c*, 52*m* and 52*bk* as a toner feeding mechanism, an optical writing unit 7, a transfer unit 15 as a transfer mechanism, a sheet feeding cassette 26 as a sheet feeding mechanism, and a fixing unit 20 as a fixing mechanism.

The process cartridges 6*y*, 6*c*, 6*m* and 6*bk* include respective consumable image forming components to perform image forming operations for producing respective toner images with toners of different colors of yellow (y), cyan (c), magenta (m), and black (bk). The process cartridges 6*y*, 6*c*, 6*m* and 6*bk* are separately arranged at positions having different heights in a stepped manner and are detachably provided to the printer 100 so that each of the process cartridges 6*y*, 6*c*, 6*m* and 6*bk* can be replaced at once at an end of its useful life. Since the four process cartridges 6*y*, 6*c*, 6*m* and 6*bk* have similar structures and functions, except that respective toners are of different colors, which are yellow, cyan, magenta and black toners, the discussion below uses reference numerals for specifying components of the printer 100 without suffixes of colors such as y, c, m and bk.

Figure 2:
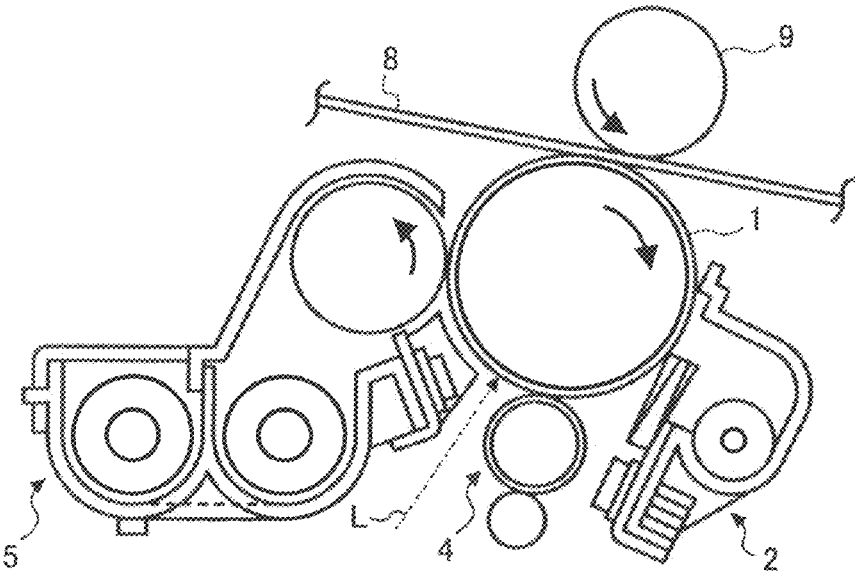
FIG. 2 is a schematic structure of a process cartridge for producing a single color toner image by using the printer of FIG. 1.

FIG. 2 shows a schematic structure of a process cartridge 6 for producing a single color toner image.

The process cartridge 6 has image forming components around it. The image forming components included in the process cartridge 6 are a photoconductive drum 1, a drum cleaning unit 2, a discharging unit (not shown), a charging unit 4, a developing unit 5, and so forth.

The photoconductive drum 1 is a rotating member including a cylindrical conductive body having a relatively thin base. In this embodiment, a drum type image bearing member such as the photoconductive drum 1 is used. However, as an alternative, a belt type image bearing member may be applied as well.

The charging unit 4 including a charging roller (not shown) is applied with a charged voltage. When the photoconductive drum 1 is driven by a rotation drive unit as a rotation drive mechanism that will be described below, and is rotated clockwise in FIG. 2, the charging unit 4 applies the charged voltage to the photoconductive drum 1 to uniformly charge the surface of the photoconductive drum 1 to a predetermined polarity.

The optical writing unit 7 of FIG. 1 is a part of the image forming mechanism, and emits four laser beams towards the photoconductive drums 1*y*, 1*c*, 1*m* and 1*bk*. When the optical writing unit 7 emits a laser beam L toward the photoconductive drum 1 of the process cartridge 6 in FIG. 1, the laser beam L is deflected by a polygon mirror (not shown) that is also driven by a motor. The laser beam L travels via a plurality of optical lenses and mirrors, and reaches the photoconductive drum 1. The process cartridge 6 receives the laser beam L, which is optically modulated. The laser beam L, according to image data corresponding to a color of toner for the process cartridge 6, irradiates a surface of the photoconductive drum 1 through a path formed between the charging unit 4 and the developing unit 5, so that an electrostatic latent image is formed on the charged surface of the photoconductive drum 1.

As shown in FIG. 1, the four toner bottles 52*y*, 52*c*, 52*m* and 52*bk* independently detachable from each other are arranged above the transfer unit 15. The toner bottles 52*y*, 52*c*, 52*m* and 52*bk* are also separately provided with respect to the respective process cartridges 6*y*, 6*c*, 6*m* and 6*bk*, and are detachably arranged to the printer 100. With the above-described structure, each toner bottle may easily be replaced with a new toner bottle when the toner bottle is detected as being in a toner empty state, for example.

The developing unit 5 of FIG. 2 visualizes the electrostatic latent image formed on the surface of the photoconductive drum 1 as a single color toner image. Thus, the toner image is formed on the surface of the photoconductive drum 1.

In FIG. 1, the transfer unit 15 is arranged above the process cartridges 6*y*, 6*c*, 6*m* and 6*bk*. The transfer unit 15 includes an intermediate transfer belt 8, a belt cleaning unit 10, four primary transfer rollers 9*y*, 9*c*, 9*m* and 9*bk*, a secondary transfer backup roller 12, a cleaning backup roller 13, and a tension roller 14. The intermediate transfer belt 8 forms an endless belt extending over the secondary transfer backup roller 12, the cleaning backup roller 13 and the tension roller 14, and rotating counterclockwise in FIG. 1. The intermediate transfer belt 8 is held in contact with the primary transfer rollers 9*y*, 9*c*, 9*m* and 9*bk* corresponding to the photoconductive drums 1*y*, 1*c*, 1*m* and 1*bk*, respectively, to form primary transfer nips between the photoconductive drum 1*y* and the primary transfer roller 9*y*, between the photoconductive drum 1*c* and the primary transfer roller 9*c*, and so forth. Corresponding to the photoconductive drum 1 of FIG. 2, the primary transfer roller 9 is arranged at a position opposite to the photoconductive drum 1 such that the toner image formed on the surface of the photoconductive drum 1 is transferred onto the intermediate transfer belt 8. The primary transfer roller 9 receives a transfer voltage having an opposite polarity, such as a positive polarity, to the charged toner to transfer the transfer voltage to an inside surface of the intermediate transfer belt 8. The rollers except the primary transfer roller 9 are grounded.

Through operations similar to those as described above, yellow, cyan, magenta and black images are formed on the surfaces of the respective photoconductive drums 1*y*, 1*c*, 1*m* and 1*bk*. Those color toner images are sequentially overlaid on the surface of the intermediate transfer belt 8, such that a primary overlaid toner image is formed on the surface of the intermediate transfer belt 8. Hereinafter, the primary overlaid toner image is referred to as a four color toner image.

The transfer unit 15 also includes a separation mechanism (not shown) to separate the intermediate transfer belt 8 from the photoconductive drums 1*y*, 1*c* and 1*m* while the intermediate transfer belt 8 is continuously held in contact with the photoconductive drum 1*bk*. The separation mechanism is used when the printer 100 performs an image forming operation producing a black-and-white image.

After the toner image formed on the surface of the photoconductive drum 1 is transferred onto the surface of the intermediate transfer belt 8, the drum cleaning unit 2 removes residual toner on the surface of the photoconductive drum 1.

In FIG. 1, the sheet feeding cassette 26 accommodates a plurality of recording media such as transfer sheets that include an individual transfer sheet S. The sheet feeding mechanism also includes a sheet feeding roller 27 and a registration roller pair 28. The sheet feeding roller 27 is held in contact with the transfer sheet S. The sheet feeding roller 27 is rotated by a roller drive motor (not shown). The transfer sheet S placed on the top of a stack of transfer sheets in the sheet feeding cassette 26 is fed and is conveyed to a portion between rollers of the registration roller pair 28. The registration roller pair 28 stops and feeds the transfer sheet S in synchronization with a movement of the four color toner image towards a secondary transfer area, which is a secondary nip portion formed between the intermediate transfer belt 8 and a secondary transfer roller 19. The secondary transfer roller 19 is applied with an adequate predetermined transfer voltage such that the four color toner image, formed on the surface of the intermediate transfer belt 8, is transferred onto the transfer sheet S. The four color toner image transferred on the transfer sheet S is referred to as a full color toner image.

The belt cleaning unit 10 removes residual toner adhering on the surface of the intermediate transfer belt 8.

The transfer sheet S that has the full color toner image thereon is conveyed further upward, and passes between a pair of fixing rollers of the fixing unit 20. The fixing unit 20 includes a heat roller 20*a* having a heater therein and a pressure roller 20*b* for pressing the transfer sheet S for fixing the four color toner image. The fixing unit 20 fixes the four color toner image to the transfer sheet S by applying heat and pressure. After the transfer sheet S passes the fixing unit 20, the transfer sheet S is discharged by a sheet discharging roller 29 to a sheet discharging tray 50 provided at the upper portion of the printer 100.

Figure 3:
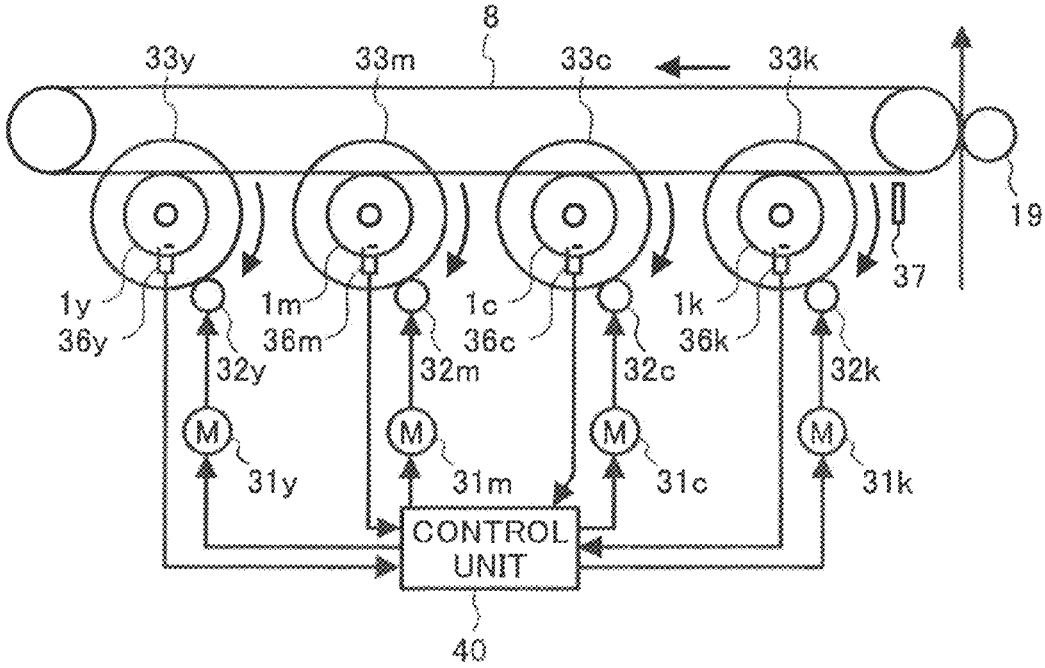
FIG. 3 is a schematic structure of an image forming operation system controlled by a control unit.

Referring to FIG. 3, a photoconductive drum drive system is described.

FIG. 3 shows a schematic structure of the photoconductive drum drive system that drives the photoconductive drum 1.

The photoconductive drum drive system includes the photoconductive drums 1*y*, 1*c*, 1*m* and 1*bk*. The photoconductive drums 1*y*, 1*c*, 1*m* and 1*bk* have similar structures and functions, except that respective toners are of different colors, which are yellow, cyan, magenta and black toners. The photoconductive drums 1*y*, 1*c*, 1*m* and 1*bk* include photoconductive drum drive gears 33*y*, 33*c*, 33*m* and 33*bk*, respectively, which are fixedly arranged at one end of shafts of the respective photoconductive drums 1*y*, 1*c*, 1*m* and 1*bk*. Shafts of the photoconductive drum drive gears 33*y*, 33*c*, 33*m* and 33*bk* and those of the photoconductive drums 1*y*, 1*c*, 1*m* and 1*bk* join together at respective joints (not shown). The photoconductive drum drive gears 33*y*, 33*c*, 33*m* and 33*bk* are fixedly arranged at the one end of the shafts of the photoconductive drums 1*y*, 1*c*, 1*m* and 1*bk*, and are rotated following rotations of the photoconductive drums 1*y*, 1*c*, 1*m* and 1*bk*, respectively. The photoconductive drum drive gears 33*y*, 33*c*, 33*m* and 33*bk* are engaged with drive transmission gears 32*y*, 32*c*, 32*m* and 32*bk*, respectively. The drive transmission gears 32*y*, 32*c*, 32*m* and 32*bk* are rotated by drive force generated by driving mechanisms, such as drive motors 31*y*, 31*c*, 31*m* and 31*bk*, respectively. The drive motors 31*y*, 31*c*, 31*m* and 31*bk* are provided at the photoconductive drums 1*y*, 1*c*, 1*m* and 1*bk*, respectively, to separately rotate the photoconductive drums 1*y*, 1*c*, 1*m* and 1*bk*.

The photoconductive drum drive system also includes a control unit 40, mark sensors 36*y*, 36*c*, 36*m* and 36*bk*, and an image reading sensor 37.

The control unit 40 as a control mechanism controls processes of the printer 100, and includes a CPU (not shown), ROM (not shown), RAM (not shown) and so forth. That is, the control unit 40 has functions to determine rotational positions of the photoconductive drums 1*y*, 1*c*, 1*m* and 1*bk* as a position sensor, and to control rotation speeds and start and end times of rotations of the drive motors 31*y*, 31*c*, 31*m* and 31*bk* as a motor controller. Thus, the position sensor includes a plurality of position sensors; therefore, the control unit 40 has functions of a plurality of position sensors. Further, the motor controller includes a plurality of motor controllers; therefore, the control unit 40 has functions of a plurality of motor controllers.

The mark sensors 36*y*, 36*c*, 36*m* and 36*bk* are provided as mark detection units for detecting specific marks of respective marking members (not shown) so that the control unit 40 can detect the rotational positions of the respective photoconductive drums 1*y*, 1*c*, 1*m* and 1*bk*. The control unit 40 receives detection signals output from the mark sensors 36*y*, 36*c*, 36*m* and 36*bk*. Based on the detection signals, the control unit 40 controls the drive motor 31*y*, 31*c*, 31*m* and 31*bk* to drive the photoconductive drums 1*y*, 1*c*, 1*m* and 1*bk*, respectively, so that amounts of color displacements on respective color toner images transferred onto the intermediate transfer belt 8 become minimal.

The image reading sensor 37 is used to read a test toner image, as described below.

Detailed structure and functions of the photoconductive drum drive system are described below. Since the photoconductive drums 1*y*, 1*c*, 1*m* and 1*bk* have structures and functions similar to each other, except that the toners contained therein are of different colors, the discussion below with respect to FIGS. 4 to 13 uses reference numerals for specifying components of the printer 100 without suffixes of colors such as y, c, m and bk. In other words, the photoconductive drum drive gear 33 of FIG. 4, for example, can be any one of the photoconductive drum drive gears 33*y*, 33*c*, 33*m* and 33*bk*.

Figure 4:
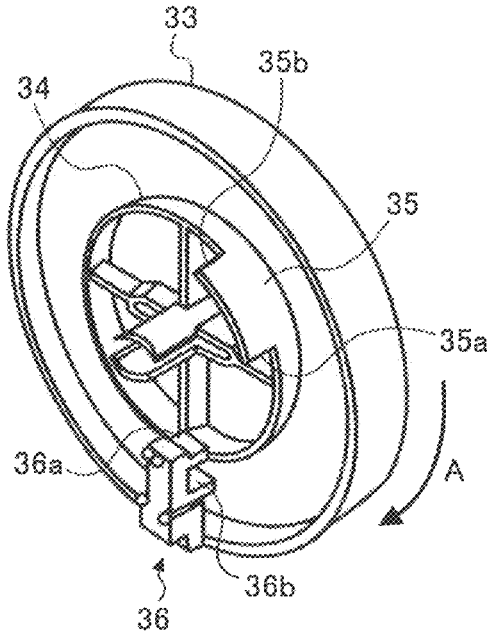
FIG. 4 is a photoconductive drum drive gear for a photoconductive drum.

FIG. 4 shows an inner surface of the photoconductive drum drive gear 33. This inner surface of the photoconductive drum drive gear 33 of FIG. 4 is engaged at a far end of the photoconductive drum 1. In other words, the photoconductive drum 1 is in front of the inner surface of the photoconductive drum drive gear 33 illustrated in FIG. 4.

The photoconductive drum drive gear 33 includes a marking member 34 and the mark sensor 36.

The marking member 34 has a circular shape with a protruding portion and a non-protruding portion both having respective lengths in a rotating direction along a circumference of the photoconductive drum drive gear 33. Hereinafter, the protruding portion of the marking member 34 is referred to as a detection mark 35, and the non-protruding portion of the marking member 34 is referred to as a mark-to-mark interval. The marking member 34 with the detection mark 35 is fixedly arranged on the inner surface of the photoconductive drum drive gear 33, and is rotated with rotations of the photoconductive drum drive gear 33, having a drum shaft (not shown) of the photoconductive drum 1 as a center of the photoconductive drum drive gear 33.

The mark sensor 36 includes a transparent optical sensor with a light emitting portion 36*a* and a light receiving portion 36*b*, which are oppositely disposed at the mark sensor 36. When the light emitting portion 36*a* emits a light beam towards the light receiving portion 36*b*, a predetermined light path is made between the light emitting portion 36*a* and the light receiving portion 36*b*. When the marking member 34 is rotated, the detection mark 35 passes across a portion of the predetermined light path between the light emitting portion 36*a* and the light receiving portion 36*b*, and blocks the light beam in the predetermined light path for a predetermined period in one cycle of the rotation of the photoconductive drum 1. The above-described portion at which the detection mark 35 crosses is referred to as a mark detection area. The mark sensor 36 detects the detection mark 35 as described below.

The drive motor 31 generates a drive force for rotating the photoconductive drum 1. When the photoconductive drum 1 is rotated by the drive force, the marking member 34 with the detection mark 35 is rotated, and the detection mark 35 moves in its rotating direction, as indicated by an arrow A. When a leading end 35*a* of the detection mark 35 passes between the light emitting portion 36*a* and the light receiving portion 36*b* of the mark sensor 36, the detection mark 35 intersects the mark detection area and blocks the light beam. At this time, the mark sensor 36 recognizes a start time of mark detection. After a trailing end 35*b* of the detection mark 35 passes between the light emitting portion 36*a* and the light receiving portion 36*b* of the mark sensor 36, the light beam emitted by the light emitting portion 36*a* successfully reaches the light receiving portion 36*b*. At this time, the mark sensor 36 recognizes an end time of mark detection. Thus, the mark sensor 36 detects the detection mark 35.

Figure 5A:
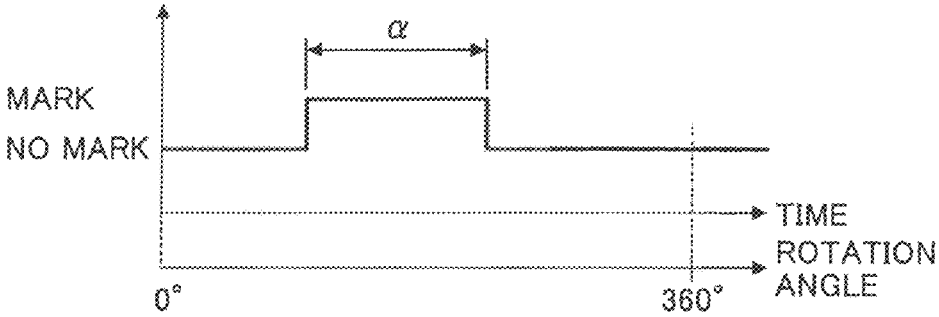
FIGS. 5A and 5B are graphs showing pulse waves of mark detection signals output from a mark sensor included in a photoconductive drum drive unit of the printer.
Figure 5B:
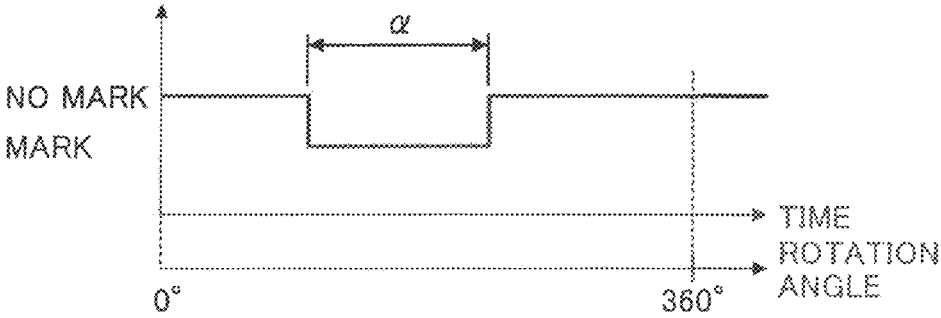

Referring to FIGS. 5A and 5B, pulse waves according to detection signals output by the mark sensor 36 are described.

In FIG. 5A, when the photoconductive drum 1 starts its rotation and the detection mark 35 blocks the light beam in the mark detection area of the mark sensor 36, an amount of light reaching the light receiving portion 36*b* decreases. When the amount of light becomes lower than a predetermined threshold of light received by the light receiving portion 36*b*, the mark sensor 36 issues a mark detection signal indicating the start time of mark detection, in this case, a H-level detection signal. When the photoconductive drum 1 further rotates and after the trailing end 35*b* of the detection mark 35 passes the mark detection area of the mark sensor 36, the amount of light reaching the light receiving portion 36*b* becomes higher than the predetermined threshold of light received by the light receiving portion 36*b*. At this time, the mark sensor 36 issues a different mark detection signal indicating the end time of mark detection, in this case, a L-level detection signal.

FIG. 5B shows an exemplary mark detection signal having a pulse wave opposite to that of the mark detection signal shown in FIG. 5A. That is, when the amount of light becomes lower than a predetermined threshold of light received by the light receiving portion 36*b*, the mark sensor 36 issues a L-level detection signal indicating the start time of mark detection, and when the amount of light becomes higher than the predetermined threshold of light, the mark sensor 36 issues a H-level detection signal indicating the end time of mark detection.

In both cases shown in FIGS. 5A and 5B, those detection signals are sent to the control unit 40.

Based on the detection signal sent from the mark sensor 36, the control unit 40 determines a rotational position, which also indicates a rotational angle, of the photoconductive drum 1 as described below, with reference to FIG. 5A.

The ROM (not shown) included in the control unit 40 previously stores data to specify a rotational position of the photoconductive drum 1 when receiving a H-level detection signal that indicates the start time of mark detection in the mark detection area. When the control unit 40 receives the H-level detection signal, it looks up to the data in the ROM, and determines the rotational position of the photoconductive drum 1 at a signal reception time, which is the start time of mark detection in this case. The ROM included in the control unit 40 also stores data of a time period from the signal reception time to a following signal reception time, which is an end time of mark detection in this case. Namely, the ROM has data of a time period $\alpha$ indicating a time period from when the H-level detection signal is received, to when the L-level detection signal is received. When the control unit 40 receives the L-level detection signal, it can calculate the signal reception time of the H-level detection signal by referring to the time period $\alpha$ in the ROM. That is, the control unit 40 can determine the rotational position of the photoconductive drum 1 when it receives either one of the H-level and L-level detection signals.

The photoconductive drum 1 rotates at a predetermined rotation speed during a steady rotation time period, and has a constant average speed of the rotation speeds. Due to the constant average speed of the photoconductive drum 1, the control unit 40 can constantly determine the rotational position of the photoconductive drum 1 after a first recognition of the rotational position of the photoconductive drum 1 as described below.

The control unit 40 also drives the photoconductive drums 1*y*, 1*c*, 1*m* and 1*bk* to have a minimal degree of color displacements of respective color toner images to be transferred onto the intermediate transfer belt 8.

Figure 6:
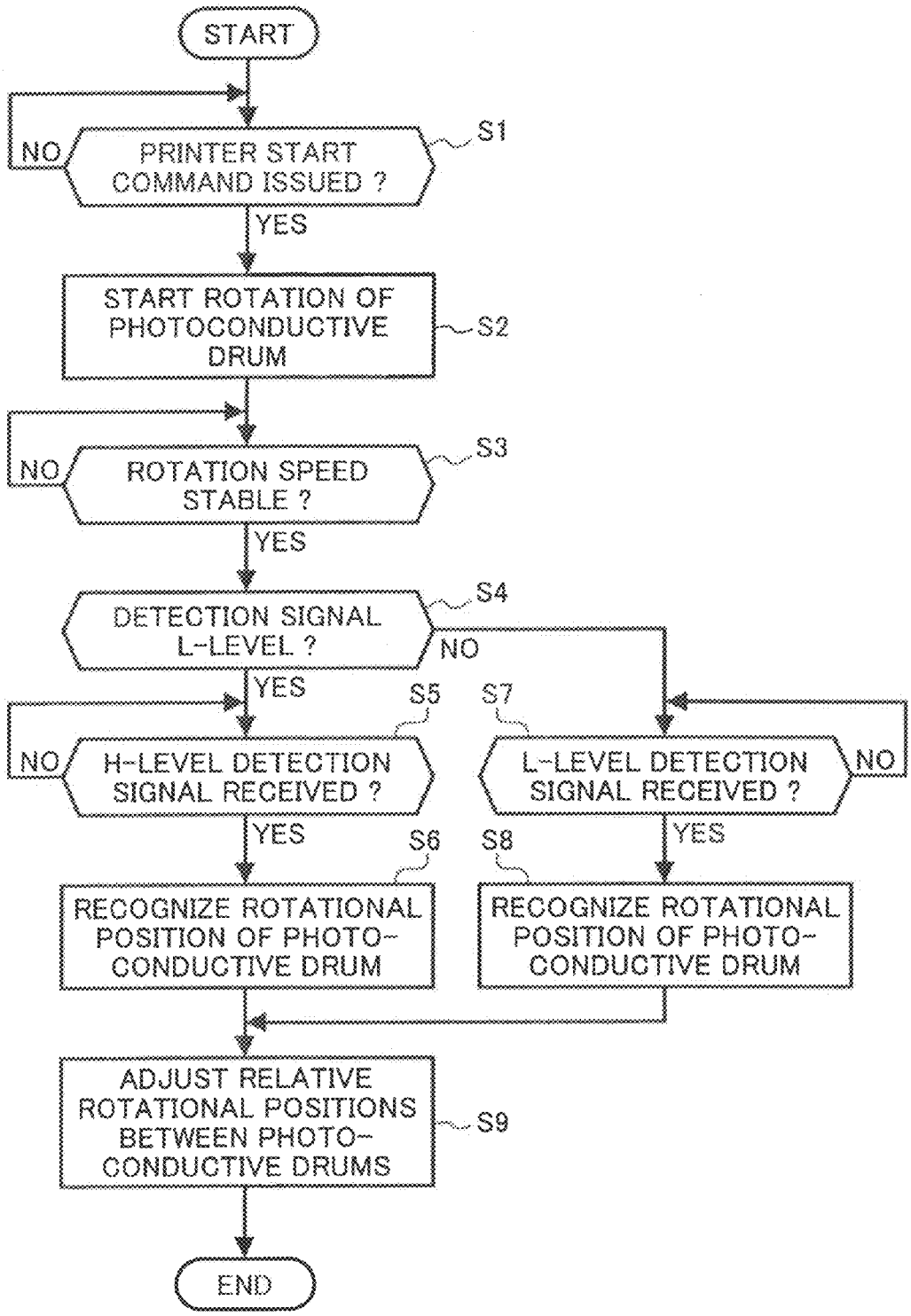
FIG. 6 is a flowchart of procedures performed by the control unit controlling of each photoconductive drum included in the printer of FIG. 1.

Referring to a flowchart of FIG. 6, a control procedure of the control unit 40 to drive each of the photoconductive drums 1*y*, 1*c*, 1*m* and 1*bk* is described. In the flowchart, one representative component among a plurality of the components is described and the suffixes y, c, m and bk are omitted.

In step S1 of FIG. 6, it is determined whether a computer such as a personal computer has issued a print start command to the printer 100. When the computer has not issued the print start command to the printer 100, the determination result in step S1 is NO, and the process of step S1 repeats until the computer issues the print start command to the printer 100. When the computer has issued the print start command to the printer 100, the determination result in step S1 is YES, and the process goes to step S2.

In step S2, the control unit 40 controls the drive motor 31 to drive the photoconductive drum 1, respectively. The control unit 40 also controls to drive the intermediate transfer belt 8. Those controls are for preparations for image forming operations to be performed later.

When a predetermined time period has passed after the process in step S2, it is determined whether the rotation speed of the photoconductive drum 1 becomes stable in step S3. When the respective rotation speed is unstable, the determination result in step S2 is NO, and the process of step S3 repeats until the rotation speed becomes stable. When the rotation speed becomes stable, the determination result in step S2 is YES, and the process goes to step S4.

When the control unit 40 receives the detection signal from the mark sensor 36, it is determined whether the detection signal received is the L-level detection signal in step S4. When the detection signal received is the L-level detection signal, the determination result is YES, and the process goes to step S5. When the detection signal received is not the L-level detection signal, the determination result is NO, and the process goes to step S7.

In step S5, it is determined whether the H-level detection signal of the start time of mark detection is received and the mark detection is started. When the H-level detection signal of the start time of mark detection is received and the mark detection is started, that is, when the determination result is YES, the process goes to step S6. When the H-level detection signal of the start time of mark detection is not received and the mark detection is not started, that is, when the determination result is NO, the process of step S5 repeats until the H-level detection signal of the start time of mark detection is received and the mark detection is started.

In step S6, the control unit 40 determines the rotational position of the photoconductive drum 1. After the rotational position is determined, the process goes to step S9.

In step S7, it is determined whether the L-level detection signal of the end time of mark detection is received and the mark detection is started. When the L-level detection signal of the end time of mark detection is received and the mark detection is started, that is, when the determination result is YES, the process goes to step S8. When the L-level detection signal of the end time of mark detection is not received and the mark detection is not started, that is, when the determination result is NO, the process of step S7 repeats until the L-level detection signal of the end time of mark detection is received and the mark detection is started.

In step S8, the control unit 40 determines the rotational position of the photoconductive drum 1. After the rotational position is determined, the process goes to step S9.

In step S9, the control unit 40 controls the drive motor 31 and adjusts relative rotational positions between the photoconductive drums 1 so that a degree of the color displacements of the color toner images become minimal when the color toner images are transferred from the respective photoconductive drums 1 onto the intermediate transfer belt 8. The control unit 40 includes the RAM (not shown) as a storing means. The RAM stores relative relationship data to specify a predetermined relative relationship of the rotational positions of the photoconductive drums 1 so that a degree of the displacements of the color toner images to be overlaid on the intermediate transfer belt 8 becomes minimal. The control unit 40 controls the drive motor 31 so that the rotational positions between the photoconductive drums 1 can have the predetermined relative relationship stored in the RAM. In the present invention, by reference to the photoconductive drum 1*bk*, the rotational positions of the photoconductive drums 1*y*, 1*c* and 1*m* are adjusted. For example, the rotation speeds of the photoconductive drums 1*y*, 1*c* and 1*m* are accelerated or decelerated, respectively, to adjust the rotational positions. In this case, after accelerating or decelerating the rotation speeds of the photoconductive drums 1*y*, 1*c* and 1*m*, the rotation speeds are changed to their previous rotation speeds. At this time, the rotation speeds of the photoconductive drums 1*y*, 1*c*, 1*m* and 1*bk* are adjusted so that the predetermined relative relationship specified by the relative relationship data may be obtained.

Accordingly, variations of respective phases in the surface travel velocities of the plurality of photoconductive drums can be synchronized so that color displacements can be prevented.

Also, based on the relative relationship data suitable to an individual printer, the relative relationship of rotational positions between the plurality of photoconductive drums can be adjusted, and the color displacements can be prevented.

During the adjustment, the above-described separation mechanism separates the intermediate transfer belt 8 from the photoconductive drums 1*c*, 1*m* and 1*bk*. This separation reduces a period that the photoconductive drums 1*y*, 1*c*, 1*m* and 1*bk* are kept in contact with the intermediate transfer belt 8, which effectively enables a longer use of the photoconductive drums 1*y*, 1*c*, 1*m* and 1*bk*. From this point of view, an image forming operation with the photoconductive drum 1*bk* producing a black-and-white image is performed while the photoconductive drums 1*y*, 1*c* and 1*m* are separated from the intermediate transfer belt 8.

Even though the relative relationships between the photoconductive drums 1*y*, 1*c*, 1*m* and 1*bk* are made to have a minimal degree of color displacements of the color toner images to be overlaid on the intermediate transfer belt 8, printers manufactured through a same series of production processes may have photoconductive drums 1*y*, 1*c*, 1*m* and 1*bk* different from other printers. This is because each printer has eccentricity of its photoconductive drum drive gear provided to the photoconductive drum, accuracy of gear molding, and variations of rotation speeds due to the joint engaging the drive gear with the photoconductive drum. The color displacements are caused because a surface travel velocity of the photoconductive drum 1 varies due to the eccentricity, and because the color toner images become elongated or shortened in a surface travel direction of the intermediate transfer member 8. When a color toner image having an elongated portion and another toner image having a shortened portion are overlaid on the intermediate transfer member 8, a color displacement of the overlaid color toner image may have a maximum degree.

In view of the above-described circumstances, the printer 100 of the present invention is provided with a data storing mechanism. The data storing mechanism measures a relative relationship of the respective rotational positions of the photoconductive drums 1*y*, 1*c*, 1*m* and 1*bk* to have a minimal degree of the color displacement of the overlaid color toner images transferred onto the intermediate transfer belt 8, and stores the measurement results to the RAM as the relative relationship data.

Specifically, the control unit 40 controls to form respective test toner images on surfaces of the photoconductive drums 1*y*, 1*c*, 1*m* and 1*bk* to detect color displacements, and to transfer the respective test toner images onto the intermediate transfer belt 8. Relative angles of the photoconductive drums 1*y*, 1*c* and 1*m* are shifted by 45 degrees per test with respect to the photoconductive drum 1*bk* that is defined to have a reference angle. With the shifted angles of the photoconductive drums 1*y*, 1*c* and 1*m*, the respective test toner images formed on the photoconductive drums 1*y*, 1*c*, 1*m* and 1*bk* are transferred onto the intermediate transfer belt 8. The above-described test toner image transfer operation is repeated eight times. The test toner images transferred onto the intermediate transfer belt 8 are then scanned by the image reading sensor 37 shown in FIG. 3. Based on the scanned data for each test toner image, the control unit 40 specifies a minimal relative angle for the color displacement of the photoconductive drums 1*y*, 1*c* and 1*m* with respect to the test toner image of the photoconductive drum 1*bk*. The specified relative angle indicates the relative relationship of the rotational positions of the photoconductive drums 1*y*, 1*c*, 1*m* and 1*bk*, so that the toner images formed on the surfaces of the photoconductive drums 1*y*, 1*c*, 1*m* and 1*bk* with an approximately maximum or approximately minimum surface travel velocity are transferred to a corresponding position on the intermediate transfer belt 8.

The test toner image can be obtained as described below. The optical writing unit 7 emits a light beam L to form an electrostatic latent image with stripes having a constant distance, for example. The developing unit 5 visualizes the electrostatic latent image as a toner image. In addition, the toner image is transferred onto the intermediate transfer belt 8. In this case, eccentricity of the photoconductive drum drive gear provided to the photoconductive drum, accuracy of gear molding, and variation of the surface travel velocity of the photoconductive drums due to speed variation caused by the joint that engages the drive gear with the photoconductive drum are recognized by variations of intervals of the striped formed on the intermediate transfer belt 8.

In the present invention, the relative relationship of relative rotational positions of the photoconductive drums 1*y*, 1*c*, 1*m* and 1*bk* are measured by shifting the relative angles by 45 degrees to specify the relative angle having a minimal color displacement. As an alternative, based on the scanned data for each test toner image for the photoconductive drums 1*y*, 1*c*, 1*m* and 1*bk*, the surfaces of the photoconductive drums 1*y*, 1*c*, 1*m* and 1*bk* having a maximum surface travel velocity may be detected to employ the relative rotational positions as the relative relationship data.

When the surfaces of the photoconductive drums 1*y*, 1*c*, 1*m* and 1*bk* having the maximum surface travel velocity are detected, the control unit 40 generates data specifying the relative relationship of the rotational positions of the photoconductive drums 1*y*, 1*c*, 1*m* and 1*bk*, so that the toner image formed on the surfaces of the photoconductive drums 1*y*, 1*c*, 1*m* and 1*bk* can be transferred onto a same position on the intermediate transfer belt 8. Nonuniformity of the surface travel velocity may periodically be caused on the photoconductive drums 1*y*, 1*c*, 1*m* and 1*bk*. However, the period of the nonuniformity is the same for the photoconductive drums 1*y*, 1*c*, 1*m* and 1*bk*. With the relative relationship, the amount of color displacements of the color toner image to be transferred onto the intermediate transfer belt 8 can be minimal.

The storing operation storing the optimal relative detection data of each printer into the RAM is sufficiently made in a stage of factory shipping of the printer. The color displacement, however, may occur due to aging. When a printer is used for a long period of time, the amount of color displacements of the color toner images transferred onto the intermediate transfer belt 8 may vary due to aging. In this case, the optimal relative relationship data stored in the stage of factory shipping of the printer may no longer be available. Therefore, the printer of the present invention has a function to perform the storing operation every time an accumulated number of printouts (an accumulated number of formed images) reach a predetermined number of printouts.

Further, when one of the photoconductive drums 1*y*, 1*c*, 1*m* and 1*bk* is removed from the printer 100 during a maintenance process, the removed photoconductive drum may be installed again to the printer, or a new photoconductive drum may be replaced to the printer 100. During the above-described maintenance process, the relative relationship of the rotational positions of the photoconductive drums 1*y*, 1*c*, 1*m* and 1*bk* may be out of balance and the minimal degree of color displacement may not be maintained. To avoid the above-described inconveniences, the storing operation previously described may be performed to store the optimal relative relationship data to the RAM. Therefore, the printer 100 of the present invention performs the storing process during a period after the replacement of the one of the photoconductive drums 1*y*, 1*c*, 1*m* and 1*bk* and before a next image forming operation starts.

As described above, when the optimal relative relationship data is changed due to age for the replacement, the relative relationship data stored in the RAM can be changed to optimal according to the changes. Therefore, even when the photoconductive drum 1 is replaced, the printer 100 can stably prevent the color displacements.

With this structure, the control unit 40 can determine the rotational position of the photoconductive drum 1 according to a signal detection time of the H-level detection signal indicating that the leading end 35*a* of the detection mark 35 reaches the mark detection area and another signal detection time of the L-level detection signal indicating that the trailing end 35*b* of the detection mark 35 passes the mark detection area. As a result, a time period corresponding to the time period for rotating the photoconductive drum 1 may be reduced by a length of the detection mark 35 in the moving direction of the detection mark 35.

With this structure, compared to the maximum time period for a system in the background printer, the maximum time period to determine the rotational position of the photoconductive drum can be reduced.

Figure 7A:
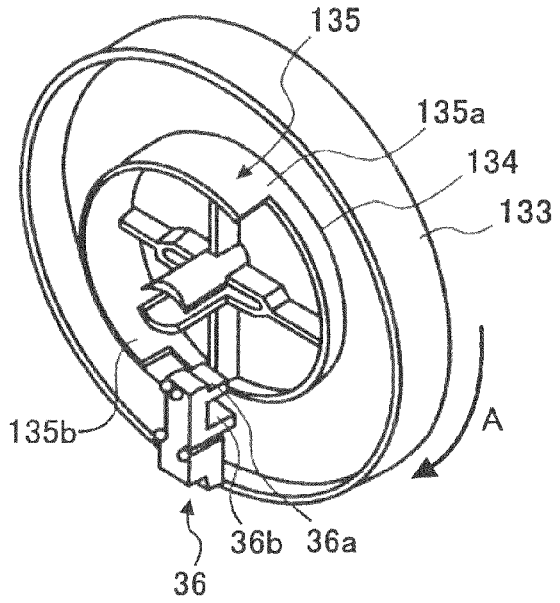
FIG. 7A is an alternative photoconductive drum drive gear with a detection mark having a length half a full rotation path of the photoconductive drum.

Referring to FIG. 7A, the photoconductive drum drive gear 33 having a marking member 134 with a detection mark 135 is described.

Figure 7B:
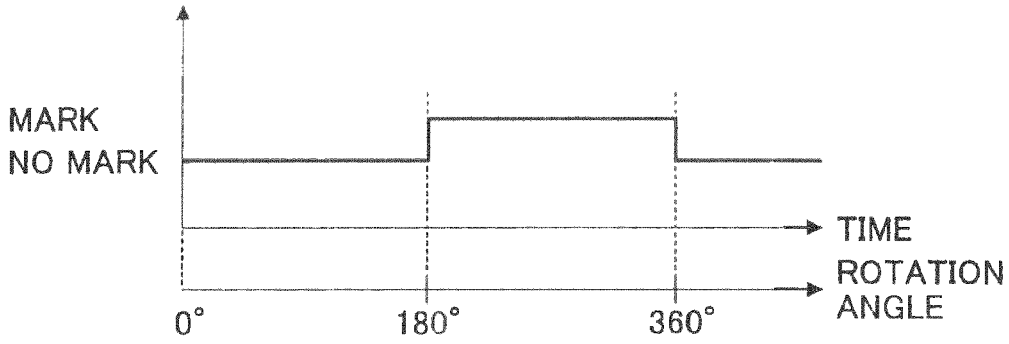
FIG. 7B is a graph showing pulse waves of the mark detection signal output from the mark sensor.

As shown in FIG. 7A, when a length of the detection mark 135 in a rotating direction of the photoconductive drum 1 equals to half the length of a circumference of the making member 134, a mark detection signal output from the mark sensor 36 may have a pulse wave form as shown in FIG. 7B. With the detection mark 135 having half the length of the circumference of the marking member 134, a maximum time period for recognizing the rotational position of the photoconductive drum 1 may be reduced to a time period for rotating the photoconductive drum 1 for half a cycle. That is, compared to a background printer that takes a time period of one cycle to determine the rotational position of the photoconductive drum, the printer 100 of the present invention may require half the cycle as the maximum time period for recognizing the rotational position of the photoconductive drum 1.

Figure 8:
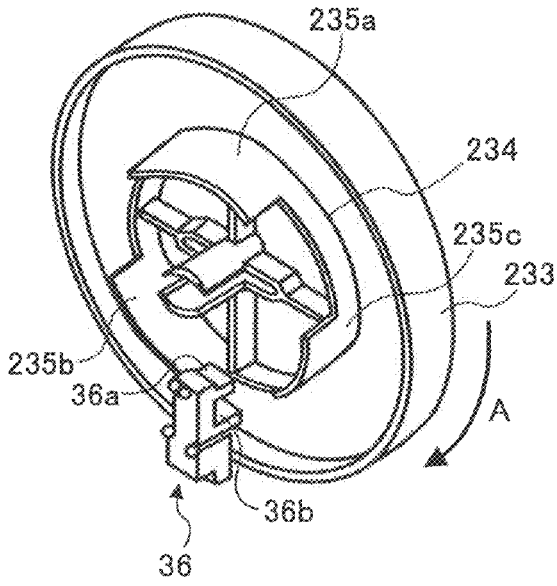
FIG. 8 is an alternative photoconductive drum drive gear with three detection marks.

Referring to FIG. 8, a structure and function of a photoconductive drum drive gear 233 for recognizing the rotational positions of the photoconductive drums 1*y*, 1*c*, 1*m* and 1*bk* according to another exemplary embodiment of the present invention is described.

The functions and structures of the photoconductive drum drive gear 233 of FIG. 8 are similar to those of the photoconductive drum drive gear 33 of FIG. 4, except for three detection marks 235*a*, 235*b* and 235*c*.

The three detection marks 235*a*, 235*b* and 235*c* are fixedly provided as protruding portions of the marking member 234, protruding in an axial direction of the photoconductive drum 1 of FIG. 2, and are arranged onto the marking member 234 along its circumference in a rotating direction of the photoconductive drum 1.

When the drive motor 31 generates a drive force and the photoconductive drum 1 is rotated by the drive force, the three detection marks 235*a*, 235*b* and 235*c* follow the rotations of the photoconductive drum 1 and move in a rotating direction of the photoconductive drum 1.

Figure 9:
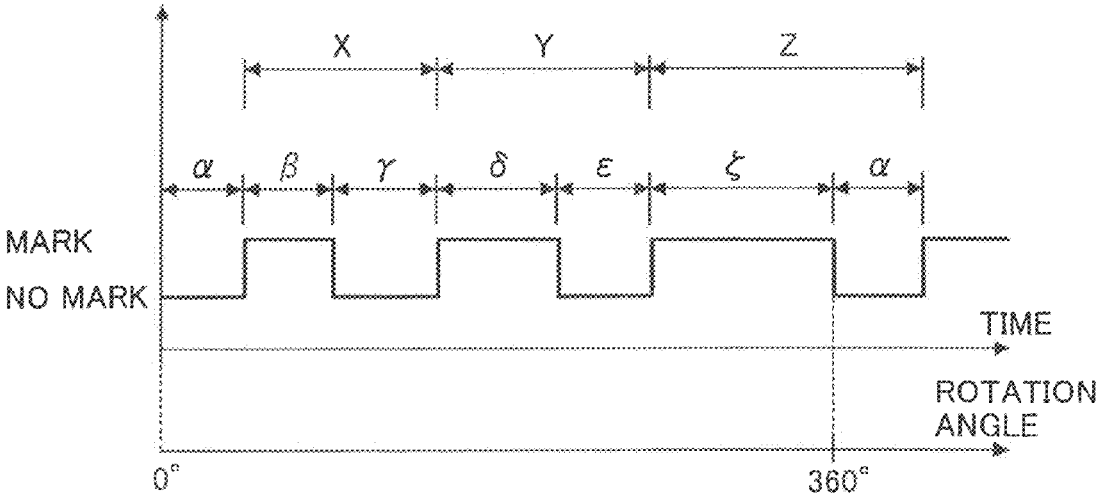
FIG. 9 is a graph showing pulse waves of the mark detection signal output from the mark sensor when the alternative photoconductive drum drive gear of FIG. 8 has the detection marks with different lengths in the rotating direction of the photoconductive drum.

Referring to FIG. 9, a pulse wave of the detection signal output from a mark sensor 236 is described.

The pulse wave of FIG. 9 rises when each of the three detection marks 235*a*, 235*b* and 235*c* blocks the light beam in the mark detection area between the light emitting portion 36*a* and the light receiving portion 36*b* of the mark sensor 36. When the light beam is blocked in the mark detection area as described above, the mark sensor 36 outputs the H-level detection signal to the control unit 40. The pulse wave of FIG. 9 falls when the light beam successfully reaches the light receiving portion 36*b* after each of the detection marks 235*a*, 235*b* and 235*c* passes the mark detection area of the mark sensor 36. When the light beam reaches the light receiving portion 36*b*, the mark sensor 36 output the L-level detection signal to the control unit 40. Based on the detection signals output from the mark sensor 36, the control unit 40 determines the rotational position, which is the rotation angle, of the photoconductive drum 1 as described below.

Since the photoconductive drum drive gear 233 includes three detection marks 235*a*, 235*b* and 235*c* along the circumference of the marking member 234 in the rotating direction of the photoconductive drum 1, the control unit 40 receives the H-level detection signals for three times per cycle and the L-level detection signals for three times per cycle, as shown in FIG. 9. In this case, the three detection marks 235*a*, 235*b* and 235*c* have different lengths in a rotating direction of the marking member 234. Accordingly, the H-level detection signals for each of the three detection marks 235*a*, 235*b* and 235*c* have different detection time periods. In FIG. 9, mark detection time periods β, δ and ζ of the H-level detection signals are different, while interval detection time periods α, γ and ϵ of the L-level detection signals are defined to be equal.

After a predetermined time period has passed before the photoconductive drums 1*y*, 1*c*, 1*m* and 1*bk* are stably rotated, the control unit 40 measures a time period between a signal reception time of a first H-level detection signal indicating the start time of the detection signal, and another signal reception time of a first L-level detection signal, which comes after the first H-level detection signal indicating the end time of the detection signal. With the measurement results, the control unit 40 recognizes the mark detection time periods β, δ and ζ of the H-level detection signals corresponding to the three detection marks 235*a*, 235*b* and 235*c* that firstly reach the mark detection area of the mark sensor 36. Since the mark detection time periods β, δ and ζ are different from each other as previously described, the control unit 40 can determine the rotational positions of the photoconductive drums according to the different mark detection time periods β, δ and ζ.

As previously described, the mark-to-mark intervals are equal in this embodiment. In other words, the interval detection time periods α, γ and ϵ of the L-level detection signals have an equal time period.

In FIG. 9, the mark detection time periods β, δ and ζ that show respective lengths of the detection marks 235*a*, 235*b* and 235*c* are combined with the interval detection time periods a, y and c that show respective mark-to-mark intervals that come immediately after the detection marks 235*a*, 235*b* and 235*c* to form time intervals X, Y and Z, respectively. That is, the time interval X includes the mark detection time period β and the interval detection time period γ, the time interval Y includes the mark detection time period δ and the interval detection time period ϵ and the time interval Z includes the detection time period ζ and the interval detection time period a. As shown in FIG. 9, the time interval Z including the detection time period ζ is the longest interval. That is, the time interval Z is the maximum time period to determine the rotational position of the photoconductive drum.

As an alternative, the marking member 234 may include three detection marks 235*a*, 235*b* and 235*c* with identical lengths and three mark-to-mark intervals with identical lengths in the rotating direction of the photoconductive drum 1. In a case where the time intervals X, Y and Z have identical lengths, each of the time intervals X, Y and Z makes one-third length in the rotating direction of the photoconductive drum per cycle. Therefore, the printer 100 of the present invention having this structure of the marking member 234 can substantially reduce the maximum time period to recognize one cycle of the photoconductive drum, compared to the background printer.

As an alternative, the time intervals may have different time periods for reducing the maximum time period to determine the rotational position of the photoconductive drum 1.

Figure 10:
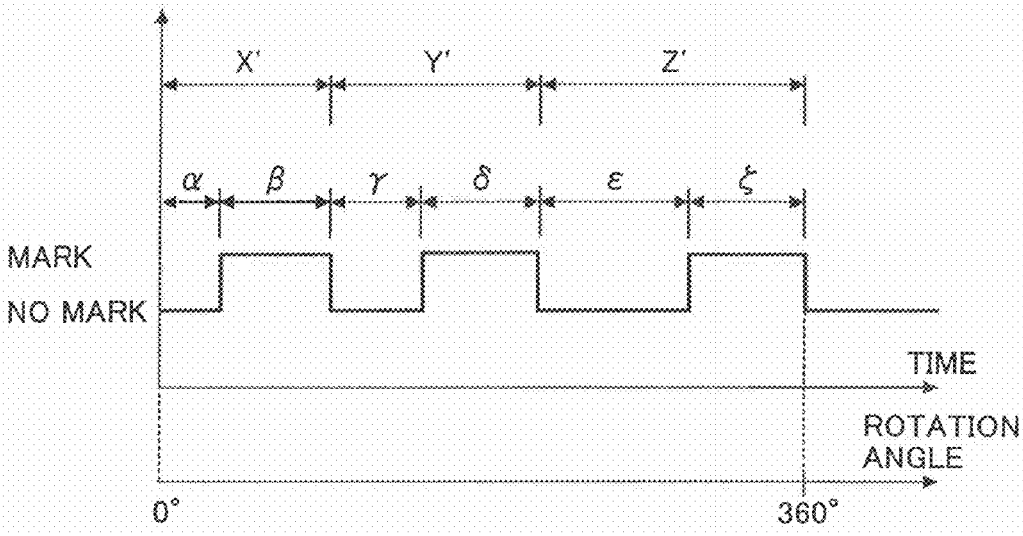
FIG. 10 is a graph showing pulse waves of the mark detection signal output from the mark sensor when the alternative photoconductive drum drive gear of FIG. 8 has mark-to-mark intervals with different lengths in the rotating direction of the photoconductive drum.

Specifically, as shown in FIG. 10, in a case where the marking member 234 is provided with different mark-to-mark intervals between the detection marks 235*a*, 235*b* and 235*c* in the rotating direction of the photoconductive drum 1, the interval detection time periods α, γ and ϵ of the L-level detection signals may be different as well. After a predetermined time period has passed and the rotation speeds of the photoconductive drums 1*y*, 1*c*, 1*m* and 1*bk* become stable, the control unit 40 measures a time period between the signal reception time of a first L-level detection signal indicating the start time of the L-level detection signal, and the signal reception time of a first H-level detection signal following the first L-level signal indicating the start time of the H-level detection signal. With the above-described measurement, the control unit 40 can recognize the interval detection time periods α, γ and ϵ of the L-level detection signals, corresponding to the mark-to-mark intervals of the marks 235*a*, 235*b* and 235*c* that cross the mark detection area of the mark sensor 36. The interval detection time periods α, γ and ϵ have respective time intervals different from each other as previously described. According to the different interval detection time periods α, γ and ϵ, the control unit 40 can determine the rotational positions of the photoconductive drums 1*y*, 1*c*, 1*m* and 1*bk*. Since the detection marks 235*a*, 235*b* and 235*c* have an equal length, the mark detection time periods β, δ and of the H-level detection signals are same. That is, the time intervals X', Y' and Z', each of which includes a combination of the interval detection time period of the L-level detection signal and the mark detection time period of the H-level detection signal, are different, depending on the interval detection time periods α, γ and ϵ. The time interval Z' including the interval detection time period E is regarded as the maximum time interval. Accordingly, the time interval Z' is also regarded as the maximum time period to determine the rotational position of the photoconductive drum 1.

As an alternative, a marking member may include three sections including three pairs of mark and interval having an equal length in a circumferentially rotating direction of the marking member. Each of the three pairs may include one mark and an interval following immediately after the mark. In a case where the time intervals X', Y' and Z' have identical lengths, each of the time intervals X', Y' and Z' makes one-third length in the rotating direction of the photoconductive drum per cycle. Therefore, the printer 100 of the present invention having this structure of the marking member 234 can substantially reduce the maximum time period to recognize one cycle of the photoconductive drum, compared to the background printer.

As an alternative, each detection mark and mark-to-mark interval may have different lengths in a rotating direction of the photoconductive drum 1 to further reduce the maximum time period to determine the rotational position of the photoconductive drum.

Figure 11:
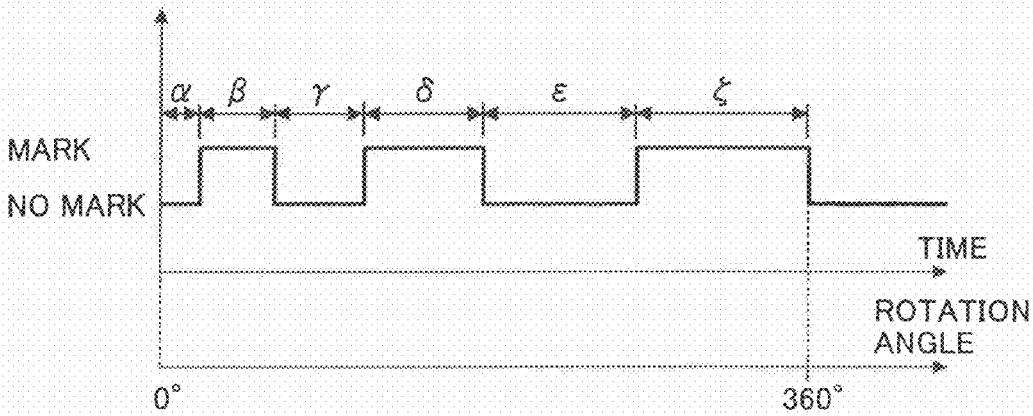
FIG. 11 is a graph showing pulse waves of the mark detection signal output from the mark sensor when the alternative photoconductive drum drive gear of FIG. 8 has detection marks and mark-to-mark intervals with different lengths in the rotating direction of the photoconductive drum.

Referring to FIG. 11, a pulse wave of a plurality of detection marks and mark-to-mark intervals with different lengths in the rotating direction of the photoconductive drum 1 is described.

As shown in FIG. 11, the mark detection time periods β, δ and ζ of the H-level detection signals are different, and the interval detection time periods α, γ and ϵ of the L-level detection signals are also different. When a first L-level detection signal is detected after a predetermined time period has passed and the rotation speed of the photoconductive drums 1*y*, 1*c*, 1*m* and 1*bk* become stable, the control unit 40 measures a time interval between a signal reception time of a H-level detection signal indicating a start time of the mark detection signal, following immediately after the L-level detection signal, and another signal reception time of a second L-level detection signal indicating an end time of the mark detection signal, following immediately after the H-level detection signal.

In a case where a H-level detection signal is detected after the predetermined time period has passed and the rotation speed of the photoconductive drums 1*y*, 1*c*, 1*m* and 1*bk* become stable, the control unit 40 measures the interval detection time periods α, γ and ϵ between a signal reception time of a L-level detection signal indicating an end time of the mark detection signal, following immediately after the H-level detection signal, and another signal reception time of a second H-level detection signal indicating a start time of the mark detection signal, following immediately after the L-level detection signal. According to results of the above-described measurements, the control unit 40 determines the rotational position of the photoconductive drum 1. In this case, after the predetermined time period has passed and the rotation speeds of the photoconductive drums 1*y*, 1*c*, 1*m* and 1*bk* become stable, a first signal reception time of the first detection signal may be either the H-level detection signal or the L-level detection signal. In either case, the maximum time interval to determine the rotational position of the photoconductive drum 1 may be further reduced.

Figure 12:
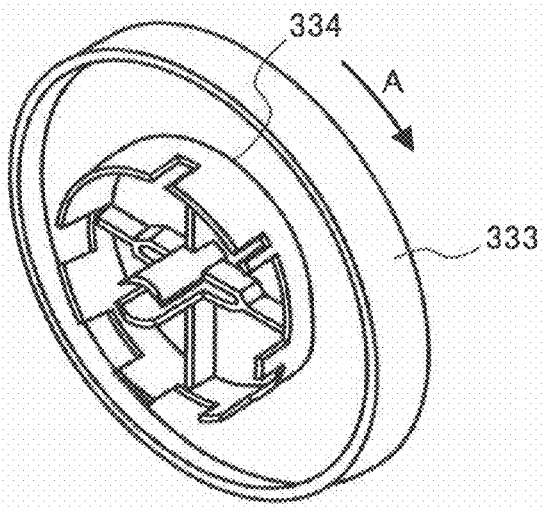
FIG. 12 is an alternative photoconductive drum drive gear having eight detection marks of the marking member that rotates with rotations of the photoconductive drum.

Referring to FIG. 12, a photoconductive drum drive gear 333 having a marking member 334 with a plurality of detection marks having different lengths in its rotating direction is described.

In FIG. 12, a plurality of detection marks (e.g., eight detection marks in the figure) with different lengths in the rotating direction are provided to the marking member 334. With the plurality of detection marks, the maximum time interval to determine the rotational position of the photoconductive drum may be reduced. When a combination of one detection mark and one mark-to-mark interval that comes immediately after the detection mark in a rotating direction of the marking member 334 is made, the marking member 334 shown in FIG. 12 has eight combinations of time intervals. Since one combination has a total length of one detection mark and its adjacent mark-to-mark interval that is equal to each total length of the other combinations, each combination of the marking member 334 of FIG. 12 has an equal length that is one eighth of the circumference of the marking member 334.

Figure 13:
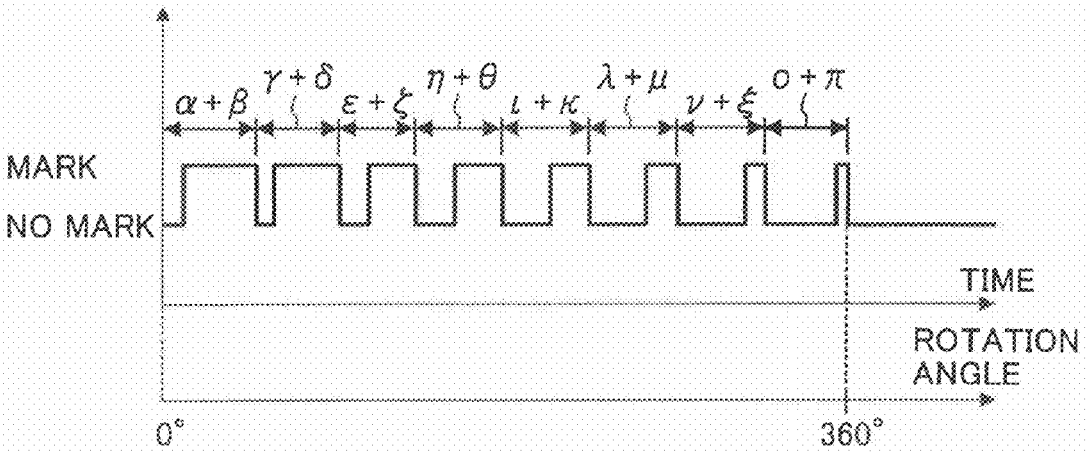
FIG. 13 is a graph showing pulse waves of the mark detection signal output from the detection sensor according to the detection marks and mark-to-mark intervals of the alternative photoconductive drum drive gear of FIG. 12.

According to the above-described structure, a pulse wave of a mark detection signal received by the control unit 40 is rendered as shown in FIG. 13. At this time, each of sums of the mark and interval detection time periods α+β, γ+δ, ϵ+ζ, η+θ, ι+κ, λ+μ, ν+ξ, ο+π corresponds to one-eighth of one cycle of the photoconductive drum 1. That is, each of the mark and interval detection time periods α+β, γ+δ, ϵ+ζ, η+θ, ι+κ, λ+μ, ν+ξ, ο+π have a rotation angle of 45 degrees of the photoconductive drum 1. The maximum time period that is taken until the photoconductive drum 1 can determine its rotational position may be set to one-eighth of that of a background system, thereby substantially reducing the maximum time period.

As an alternative, at least two lengths of the detection marks 235*a*, 235*b* and 235*c* and the mark-to-mark intervals in a rotating direction of the marking member 334 may be different to determine the rotational position of the photoconductive drum so that the maximum time period can be shorter than the background system.

As previously described, the printer 100 includes four process cartridges 6*y*, 6*c*, 6*m* and 6*bk*. The four process cartridges 6*y*, 6*c*, 6*m* and 6*bk* are individually detachable from the printer 100. Since the process cartridges 6*y*, 6*c*, 6*m* and 6*bk* have similar structures and functions, except that toner images developed therein are of different colors, the discussion regarding the process cartridges 6*y*, 6*c*, 6*m* and 6*bk* and image forming components associated with the process cartridges 6*y*, 6*c*, 6*m* and 6*bk* will be made without color suffixes. The process cartridge 6 is integrally provided with at least one photoconductive drum 1, the drum cleaning unit 2, the charging unit 4, the developing unit 5 and so forth, as shown in FIG. 2. The at least one photoconductive drum 1 includes any one of the marking member 34 of FIG. 4, the marking member 134 of FIG. 7A, the marking member 234 of FIG. 8, and the marking member 334 of FIG. 12 that are fixedly provided thereto.

With this structure, the maximum time period to determine the rotational position of the photoconductive drum is reduced without substantially changing the structure of the printer 100. That is, if a program of the control unit 40 of the printer 100 is changed and if the marking members 34, 134, 234 and 334 are changed, the above-described printer 100 can be made. Accordingly, when the process cartridge 6 including the photoconductive drum 1 with one of those marking members 34, 134, 234 and 334 fixedly arranged thereto is used, and when the process cartridge 6 is replaced with another process cartridge having the above-described structure, a change of the program of the control unit 40 is merely required.

In the above-described embodiments, the rotation drive unit of the photoconductive drum used in an image forming apparatus is described. However, utility of the present invention is not limited to the above-described photoconductive drum, and may provide a same effect to another rotating member.

In the above-described embodiments, the adjustments of the relative relationship of the rotational positions between the plurality of photoconductive drums are shown. However, utility of the present invention is not limited to the above-described adjustments, and may have a function to detect the rotational position of a rotating member and to apply an adjustment to make the rotational position agree with a target position at a predetermined time.

In the above-described embodiments, the structure in which color toner images formed on the plurality of photoconductive drums are transferred onto a recording medium via the intermediate transfer member is described. However, utility of the present invention is not limited to the above-described structure, and may be applied to a structure in which the color toner images are directly transferred onto the recording medium.

In the above-described embodiments, a marking member having at least one protruding portion as a detection mark in a rotating direction of the photoconductive drum. However, a detection mark other than the above-described detection mark may be applied. In addition, a mark detection unit detecting the detection mark may be a unit other than the transmission optical sensor.

In the above-described embodiments, one mark sensor is provided in the image forming apparatus. However, a plurality of mark sensors having respective mark detection areas on a rotation path of the respective detection marks may be applied. Thereby, the maximum time period to determine the rotational position of the photoconductive drum can be further reduced.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus including a gear, the gear comprising:

a hole arranged at substantially a center of the gear through which a shaft of a rotating member is engaged;

an engagement portion arranged on an outer circumference of the gear to receive a drive force to rotate the gear; and a single circular ridge arranged between the hole and the engagement portion, the single circular ridge including at least two notches and at least two protruding portions extending from a surface of the gear, and arranged at a distance from the hole, the at least two notches having different lengths, wherein the gear drives a portion of the image forming apparatus, wherein the at least two protruding portions pass through a position sensor that detects a rotational position of the rotating member based on a position of the at least two protruding portions, and wherein a gap is disposed between the rotating member and the single circular ridge in an axial direction of the shaft of the rotating member, wherein lengths of each of the at least two notches of the single circular ridge in a direction of rotation of the shaft of the rotating member are smaller than lengths of each of the at least two protruding portions of the single circular ridge in the direction of rotation.

2. The image forming apparatus according to claim 1, wherein the single circular ridge is divided into multiple protruding portions having equal lengths.

3. The image forming apparatus according to claim 1, wherein lengths of each of the at least two notches of the single circular ridge in the axial direction of the shaft of the rotating member are smaller than lengths of each of the at least two protruding portions of the single circular ridge in the axial direction.

4. The image forming apparatus according to claim 1, wherein lengths of each of the at least two notches of the circular ridge in a direction of rotation of the shaft of the rotating member is smaller than lengths of each of the at least two protruding portions of the circular ridge in the direction of rotation.

5. The image forming apparatus according to claim 1, wherein the gear includes a drive gear to transmit power to the rotating member of an image forming apparatus that incorporates the gear.

6. The image forming apparatus according to claim 1, wherein the gear includes a portion that radiates from the hole in all directions toward the circular ridge of the gear between the hole and the single circular ridge.

7. The image forming apparatus according to claim 1, wherein the hole includes an elongated hole arranged in a direction perpendicular to an insertion direction of the shaft of the rotating member to serve as an anti-rotation stopper to stop a rotation of the shaft.

8. The image forming apparatus according to claim 1, wherein the number of the at least two notches is equal to the number of the at least two protruding portions.

9. The image forming apparatus according to claim 1, wherein the rotating member is an image bearing member.

10. The image forming apparatus according to claim 9, wherein the image bearing member and the gear are attached to a common shaft.

11. An image forming apparatus including a rotation position detector, the rotation position detector comprising:

a gear comprising a hole arranged at substantially a center of the gear through which a shaft of a rotating member is engaged, an engagement portion arranged on an outer circumference of the gear to receive a drive force to rotate the gear, and a single circular ridge arranged between the hole and the engagement portion, at a distance from the hole, and including at least two notches and at least two protruding portions extending from a surface of the gear, wherein the gear drives a portion of the image forming apparatus; wherein lengths of each of the at least two notches of the single circular ridge in a direction of rotation of the shaft of the rotating member are smaller than lengths of each of the at least two protruding portions of the single circular ridge in the direction of rotation; and an optical sensor integrally including a light emitting unit and a light receiving unit to cause a light path of a light beam emitted by the light emitting unit to intersect a ridge of the at least two protruding portions, the optical sensor detecting a rotation position of the rotating member depending on whether or not one of the protruding portions intersects the light path of the light beam.

12. The image forming apparatus according to claim 11, wherein the light path of the light beam is emitted in a direction perpendicular to an axial direction of the gear by the light emitting unit.

13. The image forming apparatus according to claim 11, wherein the rotating member is an image bearing member.

14. The image forming apparatus according to claim 13, wherein the image bearing member and the gear are attached to a common shaft.

15. The image forming apparatus according to claim 14, wherein:

there is a gap between the rotating member and the single circular ridge in a direction in which the shaft of the rotating member extends, and the at least two notches have different lengths.

16. An image forming apparatus, comprising:

an image bearing member to bear a latent image on a surface thereof;

a developing unit to develop the latent image formed on the surface of the image bearing member into a visible image;

a sheet container to accommodate recording media therein;

a plurality of rollers to feed and convey a recording medium of the recording media from the sheet container in a sheet conveyance direction;

a transfer unit to transfer the visible image formed on the image bearing member onto the recording medium fed via the plurality of rollers;

a fixing unit to fix the transferred visible image to the recording medium;

a rotation position detector including a gear comprising a hole arranged at substantially a center of the gear through which a shaft of the image bearing member is engaged, an engagement portion arranged on an outer circumference of the gear to receive a drive force to rotate the gear, and a single circular ridge arranged between the hole and the engagement portion, at a distance from the hole, and including at least two notches and at least two protruding portions extending from a surface of the gear; wherein lengths of each of the at least two notches of the single circular ridge in direction of rotation of the shaft of the rotating member are smaller than lengths of each of the at least two protruding portions of the single circular ridge in the direction of rotation; and an optical sensor integrally including a light emitting unit and a light receiving unit to cause a light path of a light beam emitted by the light emitting unit to intersect a ridge of the at least two protruding portions, the optical sensor detecting a rotation position of the rotating member depending on whether or not one of the protruding portions intersects the light path of the light beam.

17. The image forming apparatus according to claim 16, wherein the rotating member is an image bearing member.

18. The image forming apparatus according to claim 17, wherein the image bearing member and the gear are attached to a common shaft.

19. The image forming apparatus according to claim 18, wherein:

there is a gap between the rotating member and the single circular ridge in a direction in which the shaft of the rotating member extends, and the at least two notches have different lengths.

* * * * *